United States Patent [19]

Boysen

[11] Patent Number: 4,632,497

[45] Date of Patent: Dec. 30, 1986

[54] TERMINAL ASSEMBLY FOR ELECTRICAL APPARATUS

[75] Inventor: Gerd C. Boysen, Greenfield, Wis.

[73] Assignee: Allen-Bradley Company, Inc., Milwaukee, Wis.

[21] Appl. No.: 777,277

[22] Filed: Sep. 18, 1985

[51] Int. Cl.[4] ..... H01R 4/34

[52] U.S. Cl. ..... 339/263 R

[58] Field of Search ..... 339/263 R, 263 L, 277 R, 339/277 C

[56] References Cited

U.S. PATENT DOCUMENTS

| | | | |
|---|---|---|---|
| 4,136,924 | 1/1979 | Dobrosielski et al. | 339/263 R |
| 4,370,018 | 1/1983 | Lane, III | 339/263 R |

FOREIGN PATENT DOCUMENTS

| | | | |
|---|---|---|---|
| 2840161 | 3/1980 | Fed. Rep. of Germany | 339/263 R |
| 362135 | 7/1962 | Switzerland | 339/263 R |

*Primary Examiner*—Gil Weidenfeld
*Assistant Examiner*—Gary F. Paumen
*Attorney, Agent, or Firm*—Barry E. Sammons

[57] ABSTRACT

A three phase motor reversing assembly includes two contactors interconnected with solid flat bus bars. The terminal assembly employed on the contactors includes a stationary terminal and a captive threaded fastener slidably retained within a pocket formed from the insulating material of the contactor base. The sliding captive threaded fastener allows the bus bars used for interconnection to be mounted on the underside of the stationary terminal. External connections are made to a cable clamping device mounted on top of the stationary terminal. A bolt is inserted through all of the connections to be made and threaded into the captive threaded fastener. As the bolt is tightened, the captive threaded fastener provides a counter-torque and is drawn up until tight contact is established.

8 Claims, 3 Drawing Figures

FIG. 2
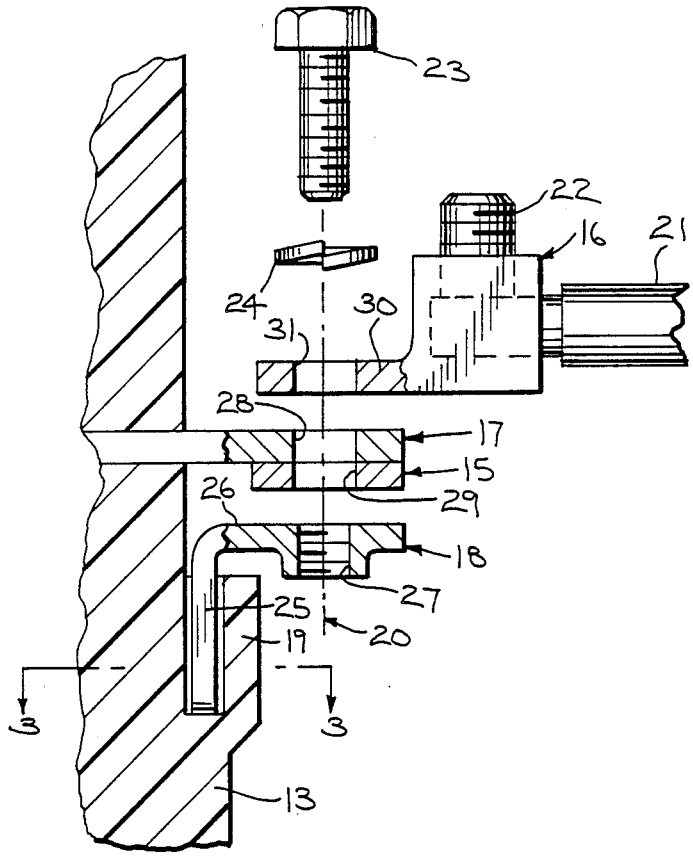
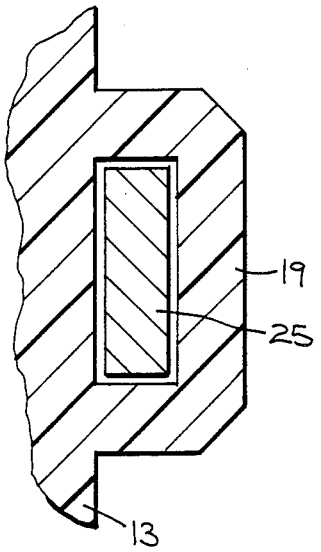
FIG. 3

TERMINAL ASSEMBLY FOR ELECTRICAL APPARATUS

BACKGROUND OF THE INVENTION

1. Field of the Invention.

The field of the invention is fasteners, particularly fasteners employed on electrical apparatus such as relays, including contactors and motor starters, and more particularly on large electrical apparatus involving the connection of very large conductors.

2. Description of the Prior Art.

Fasteners are employed on electrical apparatus to provide secure connection between conductive elements, or contacts. For electrical power connections of approximately 30 amps or more, the threaded fastener has been the preferred method because it delivers a large, positive mechanical force over a wide contact area thus insuring a low resistance connection. When the connections to be made involve very large conductors, including bus bars, which are difficult or impossible to bend by hand, the connections are usually made with a bolt and nut through a stationary terminal. Alternatively, a threaded hole is sometimes formed in the stationary terminal itself to receive the bolt as in the terminal connection for the disconnect switch of U.S. Pat. No. 4,251,700.

As shown in U.S. Pat. No. 3,564,466, bus bar connections are used, for example, to interconnect physically adjacent devices together for such applications as motor reversing. Again, when very large bus bar conductors are used, it is desirable to have a terminal assembly which allows access to both the top and bottom sides of the stationary terminal so that the bus bar connections can be made on one side, for example the bottom side, such that they will not interfere with the other connections on the top side.

Additionally, the device to which the connections are being made is usually housed inside an enclosure for safety reasons, which limits accessability to the device. In order to provide for ease of assembly and maintenance under such conditions, it is beneficial to have the fasteners used for electrical connections held captive. Where captive parts are used, it is also desirable to be able to replace the captive part only, rather than having the captive part permanently bounded to the apparatus body.

While existing terminals for making such connections have been used for many years and are generally satisfactory, none offer all of the desirable features described above in a terminal for very large conductors, i.e. threaded fasteners for contact, access to both sides of a stationary terminal, and replaceable captive parts. If a threaded stationary terminal is used as in the terminal for the disconnect switch of U.S. Pat. No. 4,251,700 then connections can be made to only one side of the stationary terminal. If a bolt and nut are used through a hole in the stationary terminal, as is the prevailing practice in the industry, then connections could be made to both sides of the stationary terminal, but the nut is not held captive.

SUMMARY OF THE INVENTION

Most electrical apparatus of the type requiring connection of large conductors consists of a base made out of an insulating material, with stationary contacts protruding from a wall of the base. In the present invention, a pocket is formed in the insulating base and a captive threaded fastener is slidably retained within the pocket. The captive threaded fastener is "L" shaped, with one arm sliding in the pocket while the other arm bends outward from the wall parallel with the stationary terminal. A through hole is formed in the stationary terminal in line with a threaded hole formed in the captive threaded fastener. As the captive threaded fastener slides in the pocket, both holes are always held in axial alignment, while the pocket also prevents the captive threaded fastener from rotating, thereby providing counter-torque during tightening or loosening. Then when a bolt is inserted through the stationary terminal, through the conductors to be connected, and threaded into the captive threaded fastener, the captive threaded fastener is free to slide in the pocket and be drawn up tight against the connection.

A general object of this invention is to provide a terminal assembly for large electrical connections utilizing a captive threaded fastener capable of providing counter-torque.

A more specific object of this invention is to provide a terminal assembly with a captive threaded fastener in which a conductor can be connected between the stationary terminal and the captive threaded fastener. Before a connection is made, the female threaded fastener is free to slide away from the stationary terminal thus allowing access to both sides of the stationary terminal.

A still more specific object of this invention is to provide a terminal assembly with a captive threaded fastener which accommodates a solid, flat bus bar conductor between the stationary terminal and the captive threaded fastener for establishing parallel connections to other electrical apparatus.

Another object of this invention is to provide a terminal assembly with a captive threaded fastener which can be removed for replacement through disassembly of the electrical apparatus containing the terminal. In the present invention, the female threaded fastener cannot slide out of the pocket because the stationary terminal is in the way. Once the stationary terminal is removed through disassembly of the apparatus, the female threaded fastener can also be removed.

BRIEF DESCRIPTION OF THE DRAWINGS

FIG. 2 is a view in cross section of the contactor assembly of FIG. 1 taken along the plane indicated by line 2—2 showing the terminal of the present invention; and FIG. 3 is a view in cross section of the terminal of FIG. 2 taken along the plane indicated by line 3—3 showing a top view of the pocket in the contactor side wall.

DESCRIPTION OF THE PREFERRED EMBODIMENT

Figure 1:
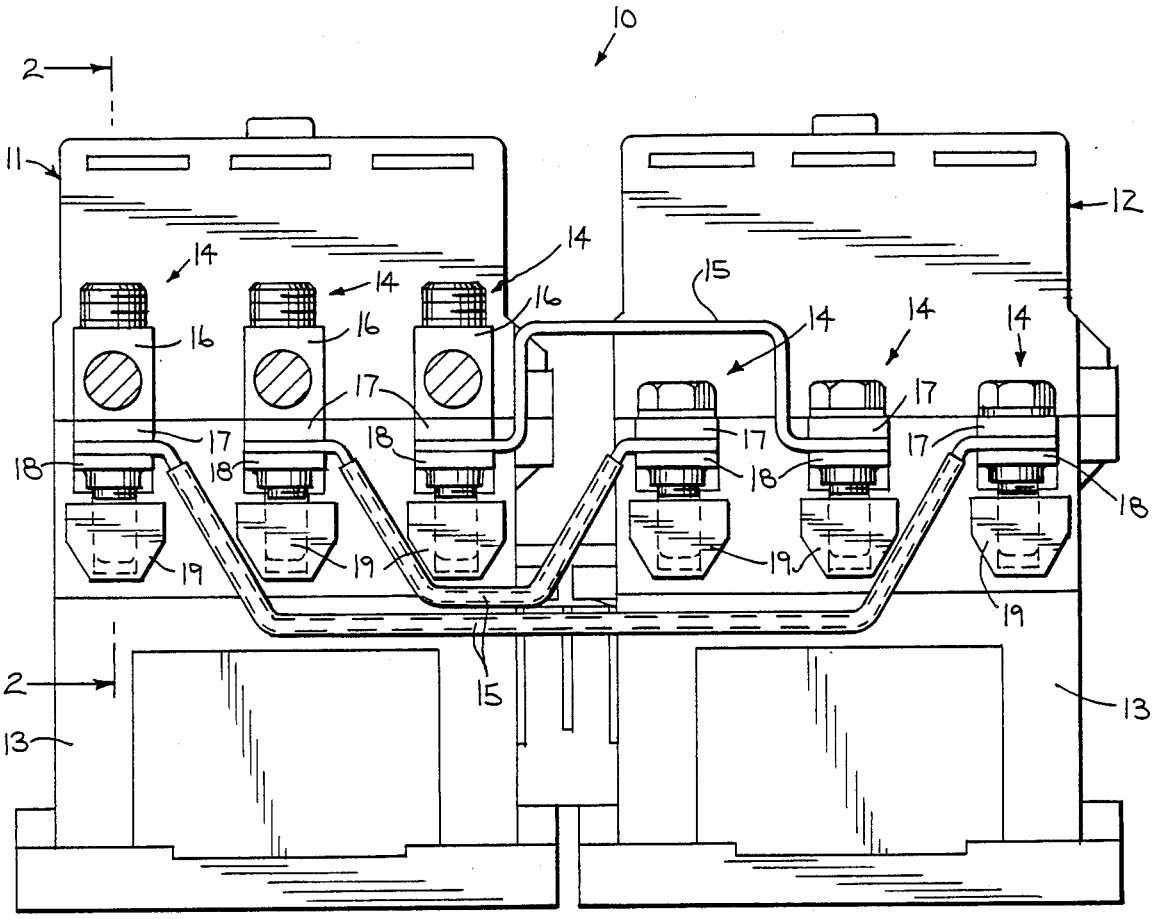
FIG. 1 is a front elevation view of a three phase reversing contactor assembly which incorporates the present invention.

Referring to FIG. 1, a typical arrangement for a three phase induction motor reversing assembly 10 is shown. The assembly 10 includes a forward contactor 11 and a reverse contactor 12.

Each contactor 11 and 12 has a base 13 made of a molded insulating material which supports three line input terminals 14 on one side as illustrated in the view of FIG. 1, and three similar load output terminals (not shown) on the opposite side. To achieve the desired motor reversing action, the terminals 14 are interconnected in well-known fashion by solid, flat bus bars 15. Atop each line input terminal 14 of the forward contactor 11 is mounted a cable clamping device 16 for external connections. Due to the size of the cable clamping device, it is desirable to route the bus bars 15 underneath the terminals 14 when possible to simplify the routing and provide better separation from inadvertent contact.

As shown best in FIG. 2, each terminal 14 has a stationary terminal 17 extending outward from the base 13 to which connections are made. Because of the size of the cable clamping device 16 and the rigidity and routing requirements of the bus bars 15, it is desirable to be able to make connections to both sides of the stationary terminal 17. Also, since the assembly 10 is typically enclosed in a housing (not shown), accessability to the underside of the terminals 14 can be severely restricted thereby making a captive fastener highly advantageous.

Referring still to FIG. 2, the invented terminal assembly includes a captive threaded fastener 18 slidably retained within a pocket 19 formed out of the insulation material of the contactor base 13. The captive threaded fastener 18 is "L" shaped with one leg 25 sliding in the pocket 19 while the other leg 26 bends away from the contactor base 13 to extend parallel with the stationary terminal 17. A threaded hole 27 in the outward extending arm 26 of the captive threaded fastener 18 is aligned along an axis of the connection indicated by dashed line 20, which is defined by a companion hole 28 in the stationary terminal 17.

As shown in FIG. 3, the interior of the pocket 19 has a rectangular cross section. The arm 25 of the captive threaded fastener 18 also has a rectangular cross-section which mates with the interior of the pocket 19 such that the captive threaded fastener 18 cannot twist in either direction, but is slidable in the direction of the axis 20.

Referring again to FIG. 2, it can be appreciated that while the captive threaded fastener 18 is free to slide up and down in the pocket 19, the threaded hole 27 in the captive threaded fastener 18 is always held in axial alignment with the hole 28 in the stationary terminal 17. The travel of the captive threaded fastener 18 is limited by the stationary terminal 17 even if nothing is connected such that the captive threaded fastener 18 cannot escape the pocket 19. Should it become necessary to replace the captive threaded fastener 18, for example due to damage, the stationary terminal 17 can be removed through disassembly thereby allowing removal and replacement of the captive threaded fastener 18.

Still referring to FIG. 2, when the captive threaded fastener 18 is in the down position, furthest away from the stationary terminal 17, there is sufficient clearance for connections to be made to the underside of the stationary terminal 17. In this embodiment, a solid, flat bus bar 15 with a hole 29 in it is positioned under the stationary terminal 17 such that the hole 29 in the bus bar 15 aligns with the axis of the connection 20. Above the stationary terminal 17, other connections can be made without interference with the connection below. Again in this embodiment, a cable clamping device 16 is connected above the stationary terminal 17. The cable clamping device 16 has a tab 30 with a hole 31 aligned on the axis of the connection 20. The body of the cable clamping device 16 has a cavity for receiving an external cable 21 and a set screw 22 for securing it.

To complete the connection, a bolt 23 and lock washer 24 are inserted along the axis of the connection 20 through the holes in the cable clamping device 16, stationary terminal 17, and bus bar 15. It is then threaded into the captive threaded fastener 18. As the bolt 23 is turned, the captive threaded fastener 18 is prevented from twisting about the axis of the connection 20 by the arm 25 of the captive threaded fastener 18 in the pocket 19 thereby providing a counter-torque. The captive threaded fastener 18 then slides up as the bolt 23 is tightened until contact is made with the bus bar 15, insuring a tight connection.

As is evident to those skilled in the art, the terminal assembly of the present invention also has utility in other electrical apparatus. For example, some of the types of apparatus that could benefit from the terminal assembly of the present invention include disconnect switches, power control center cabinets, and motor drives.

I claim:

1. A terminal assembly for electrical apparatus having an insulating base, the combination comprising:

a stationary terminal which mounted to the insulating base and which extends outward from one wall of the base, the stationary terminal having an opening therein;

a pocket formed on the wall of the base adjacent the stationary terminal;

a captive threaded fastener slidably retained within the pocket and including a first arm which extends outward from the wall of the base, said first arm having a threaded opening formed therein which is aligned with the opening in said stationary terminal; and a male fastener which extends through the opening in the stationary terminal and into threaded engagement with the threaded opening in the captive threaded fastener.

2. The terminal assembly as recited in claim 1 in which the captive threaded fastener is slidably retained with sufficient travel to allow at least one connection to the terminal to be located between the captive threaded fastener and the stationary terminal.

3. The terminal assembly as recited in claim 2 including a solid, flat bus bar conductor disposed between the captive threaded fastener and the stationary terminal.

4. The terminal assembly as recited in claim 1 in which the captive threaded fastener can be removed through disassembly of the electrical apparatus.

5. The terminal assembly as recited in claim 1 in which the pocket interior has a rectangular cross section.

6. The terminal assembly as recited in claim 1 in which the electrical apparatus is a contactor.

7. The terminal assembly as recited in claim 1 in which the captive threaded fastener further includes a second arm which extends into the pocket in sliding engagement.

8. The terminal assembly as recited in claim 7 in which the interior of the pocket has a rectangular cross section and the second arm has a rectangular cross section which mates therewith.

* * * * *